US005794362A

United States Patent [19]

Polk, III et al.

[11] Patent Number: 5,794,362

[45] Date of Patent: Aug. 18, 1998

[54] SIZE ADJUSTABLE ATHLETIC BOOT

[76] Inventors: Louis F. Polk, III, 4740 Lodge La., Excelsior, Minn. 55331; James B. Easley, 110 First Ave. NE. #1103, Minneapolis, Minn. 55413; Adam L. Luedke, 8273 Stockbridge Cir., Eden Prairie, Minn. 55344; Scott B. Olson, 885 Ferndale St., Wayzata, Minn. 55391

[21] Appl. No.: 631,842

[22] Filed: Apr. 24, 1996

[51] Int. Cl.[6] ..... A43B 3/26; A43B 23/07; A43B 5/04; A63C 1/20

[52] U.S. Cl. ..... 36/97; 36/55; 36/115; 280/7.13

[58] Field of Search ..... 36/97, 112, 115, 36/131, 132, 135, 100, 55; 280/7.13

[56] References Cited

U.S. PATENT DOCUMENTS

| | | | |
|---|---|---|---|
| D. 339,672 | 9/1993 | Olson | D2/314 |
| 526,626 | 9/1894 | Kregel | 36/97 X |
| 641,642 | 1/1900 | Gunn | 36/97 |
| 797,966 | 8/1905 | Lange et al. | 36/97 X |
| 968,427 | 8/1910 | Simon . | |
| 1,314,159 | 8/1919 | Steiger . | |
| 1,393,024 | 10/1921 | Karro . | |
| 1,539,762 | 5/1925 | Mussabini | 36/97 |
| 1,633,413 | 6/1927 | LaMarca | 36/97 X |
| 2,391,720 | 12/1945 | Ludwig | 36/11.5 |
| 2,523,449 | 9/1950 | Rosenzweig | 36/97 |
| 3,086,787 | 4/1963 | Wyche | 280/11.19 |
| 3,229,989 | 1/1966 | Papangelis | 280/11.31 |
| 3,389,481 | 6/1968 | England | 36/97 |
| 3,431,658 | 3/1969 | Finn | 36/97 X |
| 3,526,976 | 9/1970 | Jacobs | 36/115 X |
| 3,686,777 | 8/1972 | Rosen | 36/97 |
| 3,775,875 | 12/1973 | Dvorsky | 36/117.3 X |
| 3,922,800 | 12/1975 | Miller et al. | 36/97 X |
| 3,936,061 | 2/1976 | Wada | 280/11.23 |
| 4,083,128 | 4/1978 | Rossman | 36/97 |
| 4,126,323 | 11/1978 | Scherz | 280/11.12 |
| 4,299,039 | 11/1981 | Hanson | 36/97 |
| 4,724,627 | 2/1988 | Sisco | 36/119 |
| 4,747,221 | 5/1988 | Hayes | 36/119 |
| 4,920,666 | 5/1990 | Marega | 36/117.3 X |
| 4,949,479 | 8/1990 | Ottieri | 36/117 |
| 5,007,185 | 4/1991 | Lazarski | 36/135 |
| 5,031,342 | 7/1991 | Crook | 36/135 |
| 5,193,827 | 3/1993 | Olson | 280/7.13 |
| 5,314,199 | 5/1994 | Olson et al. | 280/7.13 |

FOREIGN PATENT DOCUMENTS

| | | | |
|---|---|---|---|
| 443293 | 8/1991 | European Pat. Off. | 36/97 |
| 9414350 | 7/1994 | WIPO | 36/97 |

*Primary Examiner*—B. Dayoan
*Attorney, Agent, or Firm*—Hill & Simpson

[57] ABSTRACT

A size adjustable athletic boot of a molded plastic or composite construction which is adjustable in length, width and height allowing three dimensional fit (3-D fit) for a variety of foot sizes. The boot has a base section and a tongue section which extends from a toe end of the base section. The tongue and base sections combine to define a variable volume foot space between them. A heel section telescopes over a rear end of the base section. The heel section has a heel surface which in combination with an upper surface of the base section defines a foot support surface. A cuff extends upward from a heel wall of the heel section. The cuff and a free end of the tongue section confront one another and define a foot entry opening between them. An adjustment mechanism is adapted to selectively position the heel section on the rear end of the base section to vary the length of the foot support surface relative to the length of a user's foot. An adjustable securing mechanism is adapted to adjust the foot entry opening and the foot space to conform to the user's foot and to releasably secure the user's foot within the 3-D fit boot.

37 Claims, 10 Drawing Sheets

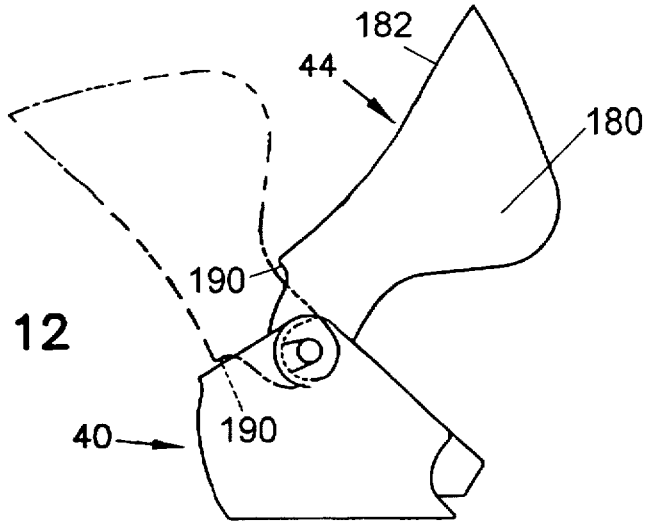
FIG. 12
FIG. 14
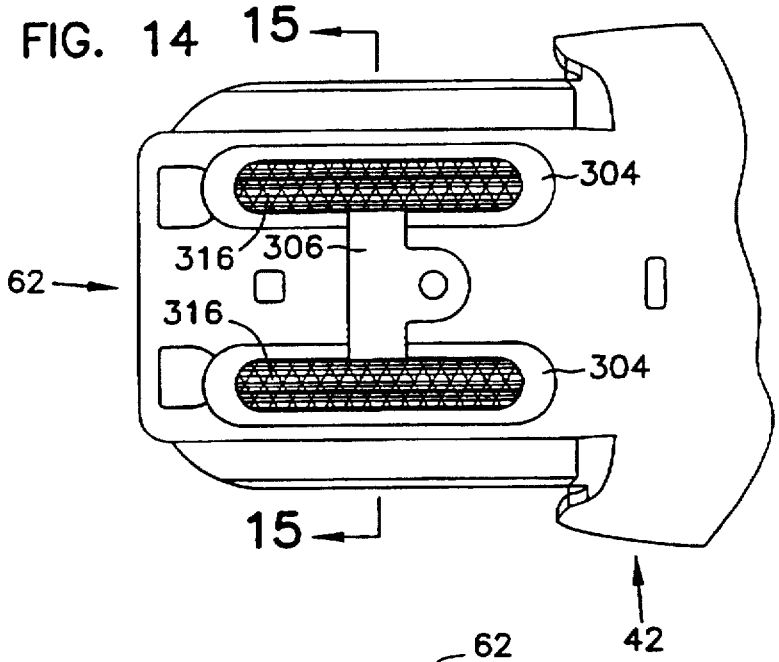
FIG. 15
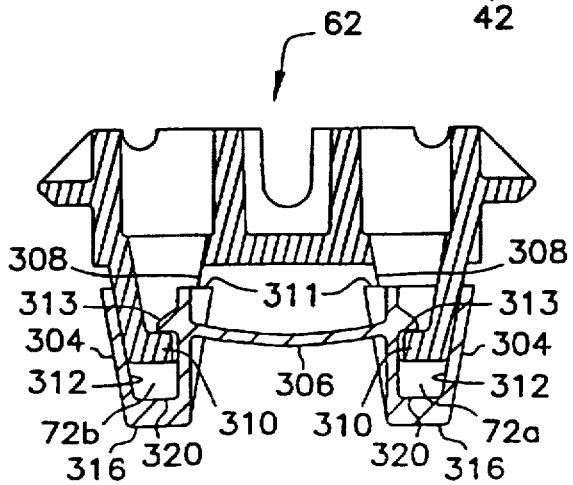

SIZE ADJUSTABLE ATHLETIC BOOT

FIELD OF THE INVENTION

The present invention relates to athletic footwear, and more specifically to an athletic boot which is adjustable in length, width and height to accommodate a variety of foot shapes and sizes.

BACKGROUND OF THE INVENTION

In-line roller skating has become increasingly popular as a form of aerobic exercise and as an enjoyable recreational activity. Because of this broad popularity, in-line skates are available in a wide variety of shapes and constructions including high performance models for competitive racing, roller hockey or acrobatic stunts as well as basic beginner models for children.

Typical in-line skates are provided with skate boots available in half-size increments similar to most other foot wear. This type of in-line skate construction adds substantial additional cost to the skate. Many more parts must be tooled and manufactured in order to provide the boots in incremental sizes. Assembly of the many parts into in-line skates is more tedious because of the need to track and monitor parts and components of the various sizes. Shipping to distributors and retailers and stocking and tracking by them are also more expensive and time consuming because of the number of different skate sizes which must be made available to meet consumer demand.

Downhill and cross-country skiing, roller skating and ice skating have been popular as forms of recreational activity and exercise for a long time. Conventional roller skates, ice skates and ski boots are also available in a wide variety of shapes and constructions. Cross-country ski boots, ice skates and conventional roller skates are provided with skate boots manufactured from either leather or similar materials or from molded plastics. Downhill ski boots on the other hand are almost exclusively provided having molded plastics shells. What is common is that ski boots, conventional roller skates and ice skates are sold and stocked in traditional half size increments for children and adults just as are in-line roller skates.

Snowboarding and mountain climbing have also increased in popularity in recent years. Manufacturers of snowboarding and mounting climbing equipment offer high-performance hard shell footwear available in traditional half-size increments as well.

A large number of businesses including skating rinks (roller and ice) and ski resorts rent equipment on site to individuals who have no equipment of their own. Storing and maintaining the number of skates or ski boots necessary to satisfy all customers and hence any size of foot can be an arduous and expensive task. Planning ahead to stock adequate supply of each size to meet the varying demand for any particular size of boot makes the task even more difficult and expensive. If fewer product variations (size variations) could be utilized to satisfy demand for all sizes of feet, the labor and cost burden would be significantly reduced.

Aside from the cost and manufacturing implications of providing athletic boots in half-size increments, fit and comfort of the athletic boots discussed above is also a concern. The various athletic boots discussed above require a user's foot to accommodate the particular size and contour of boot into which it is placed. Unless the boot fits absolutely perfectly, a user may suffer discomfort or reduced performance where a particular boot does not exactly match the contour of a user's foot. Where an athletic boot of a relatively rigid construction such as a ski boot or in-line skate boot presses against a user's foot it will cause minor discomfort, pain or even physical injury at the point of contact. An athletic boot that is loose around a portion of a user's foot allowing for some play between the boot and the foot will reduce the precise control a user has over the boot and hence will reduce performance.

A typical person commonly has one of their feet of a different size than the other. Skates, ski boots and the like of a particular size usually are provided with both the left and right boots of the exact same size. Therefore, one boot of a pair likely fits a user better than the other. To compensate, typical skates and ski boots come with laces, adjustable buckles or some combination. The basic length, width and height of a boot shell however remain the same resulting in one boot conforming better than the other to a user's feet. The fit of a boot relative to length, width and height is important for providing performance and comfort for a recreational or casual user and is extremely important when the skate or ski boot is specifically intended for high performance and competitive use. As noted previously, any play between the foot and the boot reduces a user's ability to control and manipulate the boot. Any loss of control may lead to reduced performance and even injury.

There are a number of prior art concepts which have addressed this issue by providing athletic boots having various adjustment features. One problem with the prior art is that the concepts are not intended for in-line skates in general and are not intended and useful for a high quality, performance sport market or buyer in particular.

One prior art athletic ski or skate boot is described in U.S. Pat. No. 4,083,128 to Rossman. The Rossman boot has a clam shell boot design which is split longitudinally down the middle and also split laterally forming a separate toe section. Hence, the sole of the boot is divided into four sections, each having a longitudinal slot therein. The slots on one side of the longitudinal split are angled outwardly toward the toe such that when the toe is moved away from the heel of the boot to increase the length, the width of the toe automatically increases as well. The Rossman concept does not permit for independent length and width adjustments. The Rossman boot also requires weatherproof seals over the entire longitudinal split and the lateral toe split.

Another prior art athletic skate boot is described in U.S. Pat. No. 4,126,323 to Scherz. The Scherz patent discloses a molded plastic boot with a heel and tendon guard portion which is connected to a lower boot portion by a pin and slot arrangement. The heel and tendon guard may be slid backwards and tilted slightly rearward to allow entry of a user's foot. The guard is then tilted and slid forward and buckled down to secure the user's foot. The Scherz patent may inherently allow for some very minor length variation but it does not specifically describe such a feature nor does it provide a way to select and maintain a particular boot length.

Another problem with using athletic footwear such as in-line skates is that many places of business do not permit customers to enter while wearing the skates. A potential customer must remove the skates and either enter in their socks or their bare feet, which is also rarely permitted. A user must alternatively carry with them an extra pair of shoes in order to stop and enter many establishments.

What is needed is an improved athletic boot which has adjustment characteristics for foot length, width and height. What is also needed is an athletic boot which allows adjustment of length, width and height independent of one another. What is further needed is an athletic boot which may be used for ski boots, ice skate boots, conventional and in-line roller skate boots and the like. What is still further needed is an athletic boot which is intended to satisfy the comfort and performance needs of serious athletic competitors as well as casual users. What is additionally needed is an athletic boot which eliminates the requirement of providing the associated footwear in incremental half sizes. What is also needed is an athletic boot which fits and performs satisfactorily for a user whose left and right feet are not the same size. Also what is needed is an athletic boot which conforms to the contour of a user's foot instead of requiring a user's foot to accommodate the contour of the boot. What is still further needed is an athletic boot which permits a user to convert the boot to include a walking sole or walking surface.

SUMMARY OF THE INVENTION

The present invention teaches an athletic boot of a molded plastic construction which is size adjustable in length, width and height and adaptable for use as a skate or ski boot or the like. The athletic boot allows a three dimensional fit (3-D fit) adjustment conforming the boot to a user's foot.

In one embodiment, the boot has a base section with an upper base surface and a bottom base surface. The upper base surface defines a portion of a foot support surface. The bottom base surface is adapted to carry thereon a sporting article such as in-line skate wheels, a ski, an ice skate blade, conventional roller skate wheels or the like. The base section also has a toe end and a rear end. A resilient tongue section has an end disposed adjacent the toe end of the base section and a free end.

A heel section is slidably received on the rear end of the base section and has a heel wall extending upwardly around a portion of a heel surface. The heel surface defines a portion of the foot support surface. An upper ankle section or cuff extends upward from the heel wall and faces generally toward the free end of the tongue section. The heel section is slidable relative to the base section toward and away from the toe end. An adjustment mechanism cooperates with the heel section for selectively positioning the heel section and hence the cuff longitudinally relative to the base section. This permits selectively adjusting the length of the foot support surface and therefore the length of the boot.

In an additional embodiment, the tongue and base sections cooperate to define both a foot space between the two sections and a side opening on each side of the boot. The tongue section and cuff cooperate to define a foot entry opening for slipping the boot onto a user's foot and for capturing the user's ankle therebetween once the user's foot is completely within the boot. The boot side openings are positioned on the boot such that the metatarsus (essentially the ball or widest part) of a user's foot will be directly adjacent the openings. This is intended such that feet of different widths may be comfortably accommodated within the boot. The foot space is variable to accommodate different foot heights (between the plantar and dorsal surfaces of a foot) and is provided by the resiliency of the tongue section. The free end and most of the entire length of the tongue flexes somewhat toward and away from the upper surface of the base section to compensate for varying ankle circumferences and foot heights.

One or more adjustable securing mechanisms are included on the boot for selectively conforming the foot entry opening around a user's ankle and the foot space to the dorsal surface of the user's foot. The mechanisms also are adapted to releasably secure the boot to the user's foot once the adjustments are set.

In another embodiment, a removable walking pad is provided which may be attached to the bottom of the athletic boot of the invention converting the boot to one suitable for walking. The walking pad has a main body section with a top and a bottom end. The top end has an attachment opening communicating with a recess in the main body for receiving therein an attachment bracket on the bottom of the athletic boot. The bottom end has a surface which adapts the athletic boot making it usable as a walking boot. The walking pad also has a securing mechanism such as a boss formed within the recess which overlaps a lip on the attachment bracket of the boot to hold the pad on the athletic boot.

According to one aspect of the present invention, the improved athletic boot has adjustment characteristics for foot length, width and height. According to another aspect of the present invention, the athletic boot is adjustable in length, width and height independently from one another. According to yet another aspect of the present invention, the adjustable athletic boot is adaptable for use with ski boots, ice skate boots, conventional and in-line roller skate boots and the like. According to still another aspect of the present invention, the athletic boot is intended to satisfy the comfort and performance needs of serious athletic competitors as well as casual recreational users. According to an additional aspect of the present invention, the athletic boot eliminates the requirement of providing the associated sport footwear in traditional half size increments. According to yet another aspect of the present invention, the athletic boot performs satisfactorily for a user whose left and right feet are not the same size. According to still another aspect of the present invention, the athletic boot conforms to the contour of a user's foot much more readily than conventional athletic boots. According to another aspect of the present invention, the athletic boot is convertible to provide a walking sole or walking surface.

BRIEF DESCRIPTION OF THE DRAWINGS

FIG. 12 is a side view of the assembled heel and upper ankle sections of the boot illustrated in FIG. 1.

FIG. 14 is a bottom perspective view of the in-line skate boot of FIGS. 1 and 2 having a walking pad constructed in accordance with another embodiment of the present invention attached thereto in place of a wheel bracket.

FIG. 15 is a cross sectional view taken along line 15—15 of FIG. 14 illustrating the walking pad assembled to the attachment bracket of the in-line skate boot.

DESCRIPTION OF THE PREFERRED EMBODIMENT

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
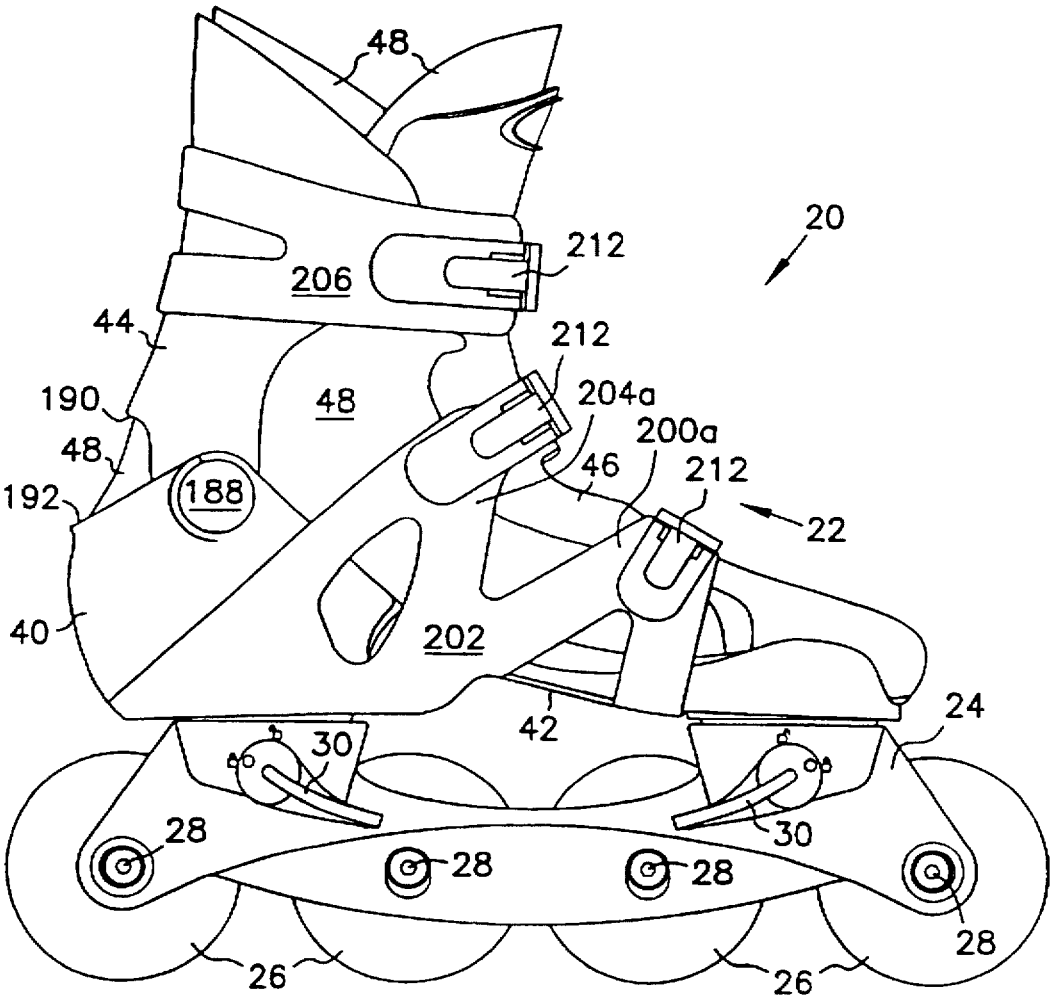
FIG. 1 is a side view of an in-line roller skate including a boot constructed in accordance with one embodiment of the present invention.

Referring now in more detail to the drawings, FIG. 1 illustrates an in-line roller skate 20 with a size-adjustable boot 22 constructed in accordance with one embodiment of the present invention allowing three dimensional fit (3-D fit) adjustment. Skate 20 includes a wheel bracket 24 which carries thereon four in-line skate wheels 26 each rotatable about essentially evenly spaced wheel axles or pivots 28. In one embodiment, wheel bracket 24 is releasably attached to boot 22 thus being removable, rotatable and interchangeable as described in U.S. Pat. Nos. 5,193,827 and 5,314,199 issued to Olson and Olson et al., respectively. Wheel bracket 24 includes a pair of locking levers 30 for securing and releasing the bracket to and from boot 22.

Figure 2:
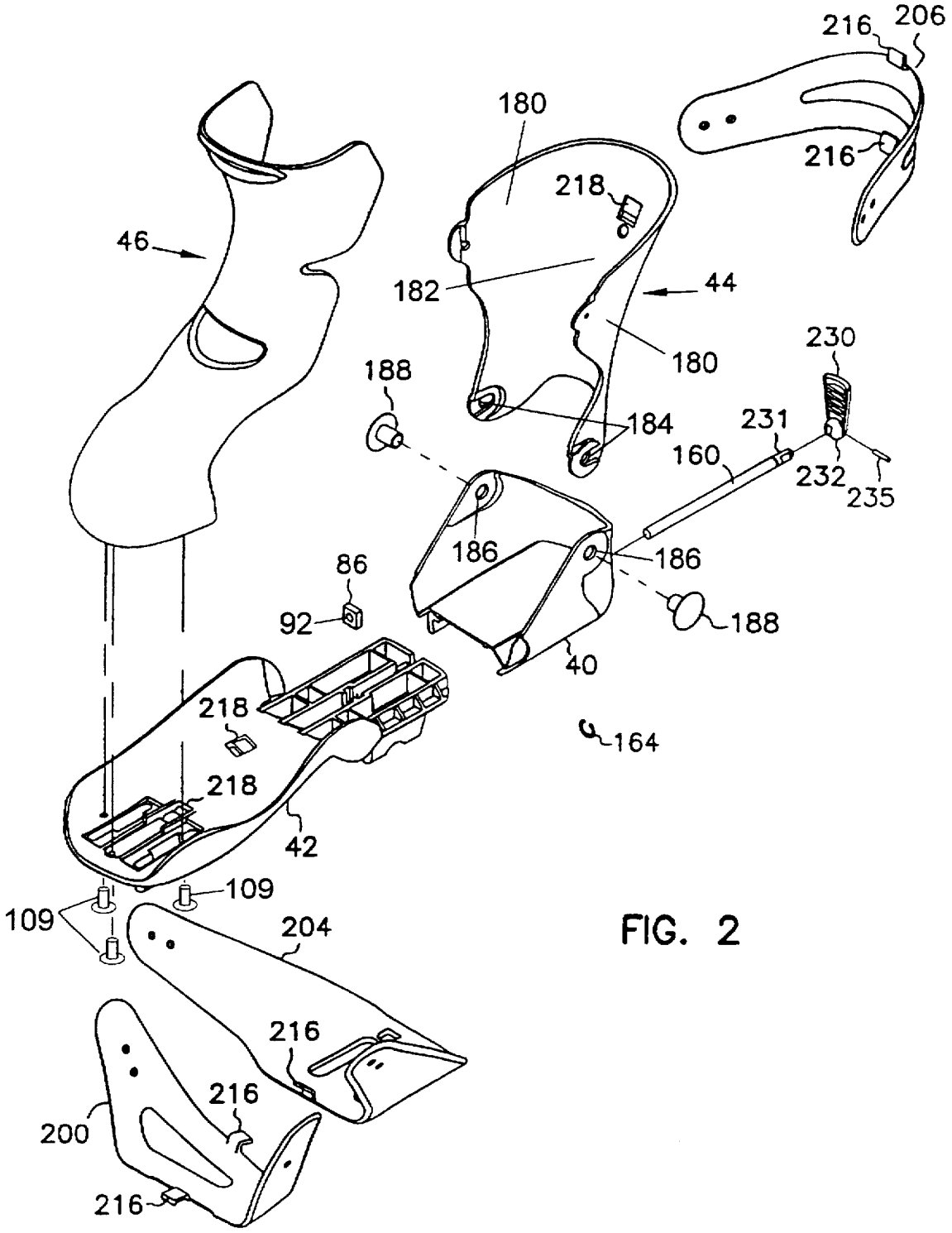
FIG. 2 is an exploded view of the boot illustrated in FIG. 1.

FIG. 2 illustrates boot 22 in exploded view. Boot 22 includes a heel section 40, a base section 42, an upper ankle section or cuff 44, a tongue section 46 and a boot liner 48. The 3-D fit boot of the present invention may be adapted for use with other types of sporting equipment. As will be readily apparent to those skilled in the art, boot 22 as described herein is easily adaptable for use as an in-line roller skate boot, a cross-country or downhill ski boot, a conventional roller skate boot, an ice skate, a snowboard boot, or even a mountain climbing boot without departing from the scope of the present invention.

Figure 1A:
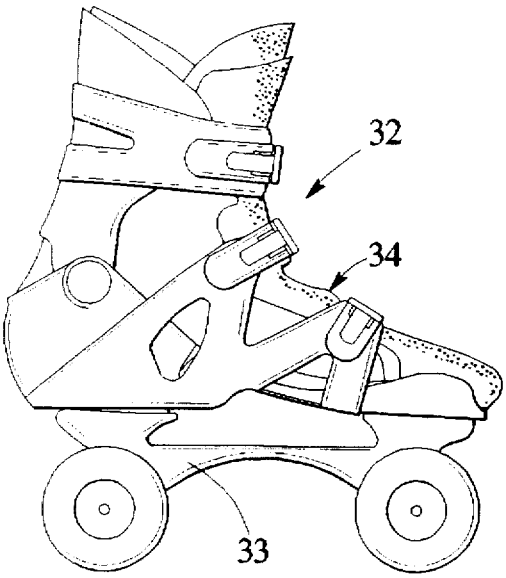
FIG. 1A is a side view of a conventional roller skate including a boot constructed in accordance with another embodiment of the present invention.
Figure 1B:
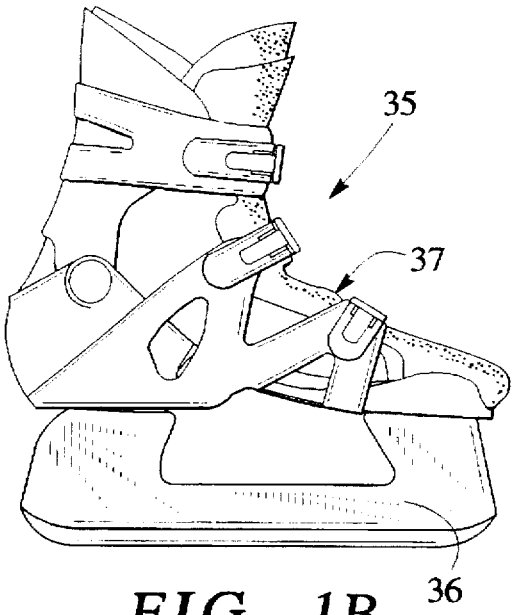
FIG. 1B is a side view of an ice skate including a boot constructed in accordance with another embodiment of the present invention.

FIG. 1A illustrates as an example a conventional roller skate 32 including a conventional roller skate wheel assembly 33 attached to a size adjustable boot 34 constructed in accordance with another embodiment of the present invention. FIG. 1B illustrates as a further example an ice skate 35 including an ice skate blade assembly 36 attached to a size-adjustable boot 37 constructed in accordance with another embodiment of the present invention. The wheel assembly 33 and blade assembly 36 are each releasably attached to the boots 34 and 37, respectively, as disclosed in the Olson '827 and '199 patents.

Figure 1C:
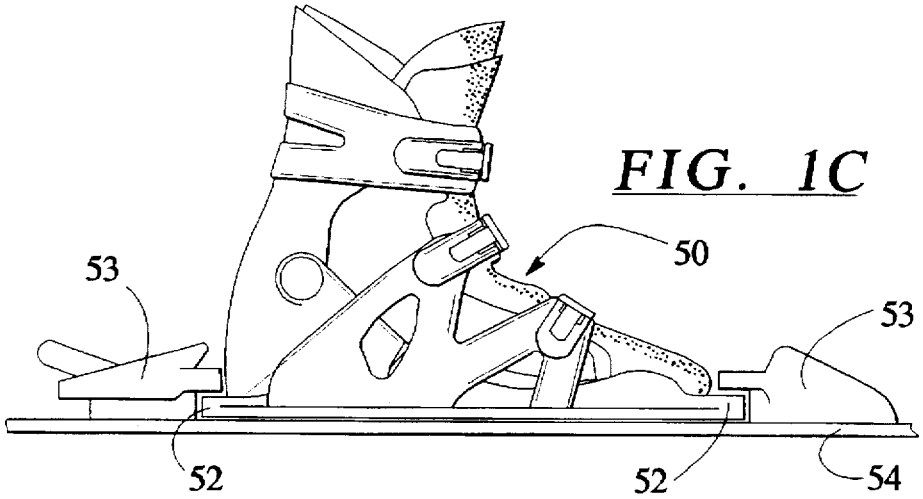
FIG. 1C is a side view of a ski boot including a boot constructed in accordance with another embodiment of the present invention.
Figure 1D:
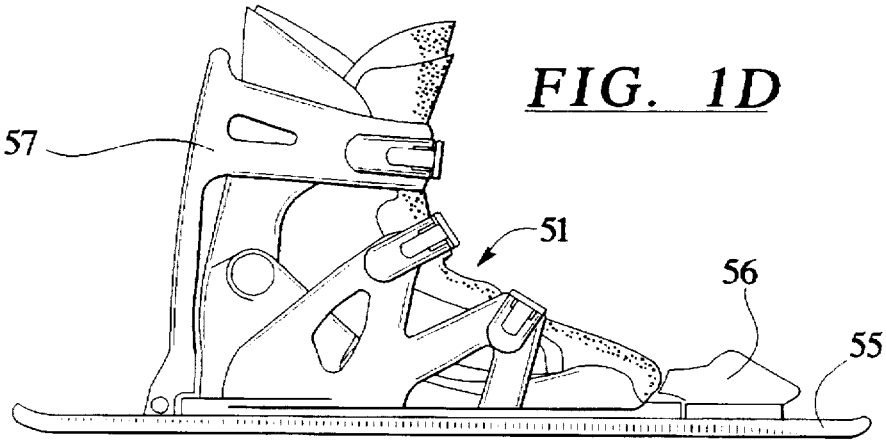
FIG. 1D is a side view of a snow board boot including a boot constructed in accordance with another embodiment of the present invention.
Figure 1E:
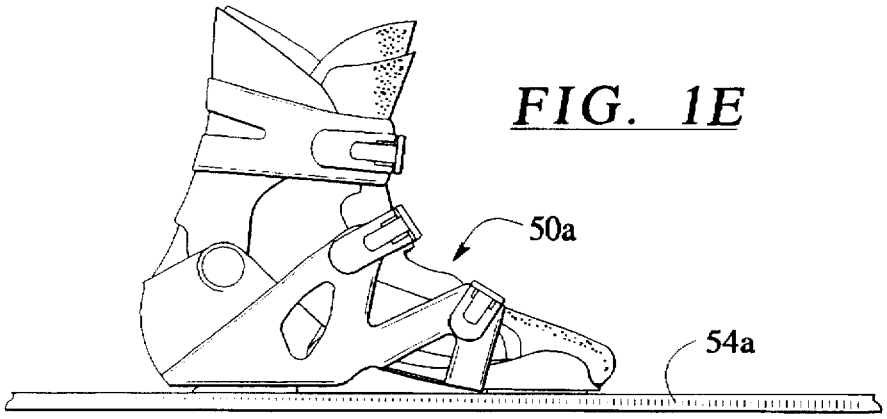
FIG. 1E is a side view of a ski boot including a boot constructed in accordance with another embodiment of the present invention.

FIG. 1C illustrates a ski boot 50 and Fig. 1D illustrates a snowboard boot 51 each constructed in accordance with further embodiments of the present invention. Ski boot 50 has attachment members 52 extending from each end of the boot for attaching the boot to a ski binding 53 carried on a conventional ski 54. Snowboard boot 51 may be attached to a snowboard 55 by a binding 56 similar to ski boot 50 or may be secured by one or more cuff straps 57 carried by the board, as illustrated in FIG. 1D, and not carried by the boot. FIG. 1E illustrates an alternative ski boot 50*a* which attaches directly to an alternative ski 54*a* as described for in-line skates in the Olson '827 and '199 patents.

Figure 3:
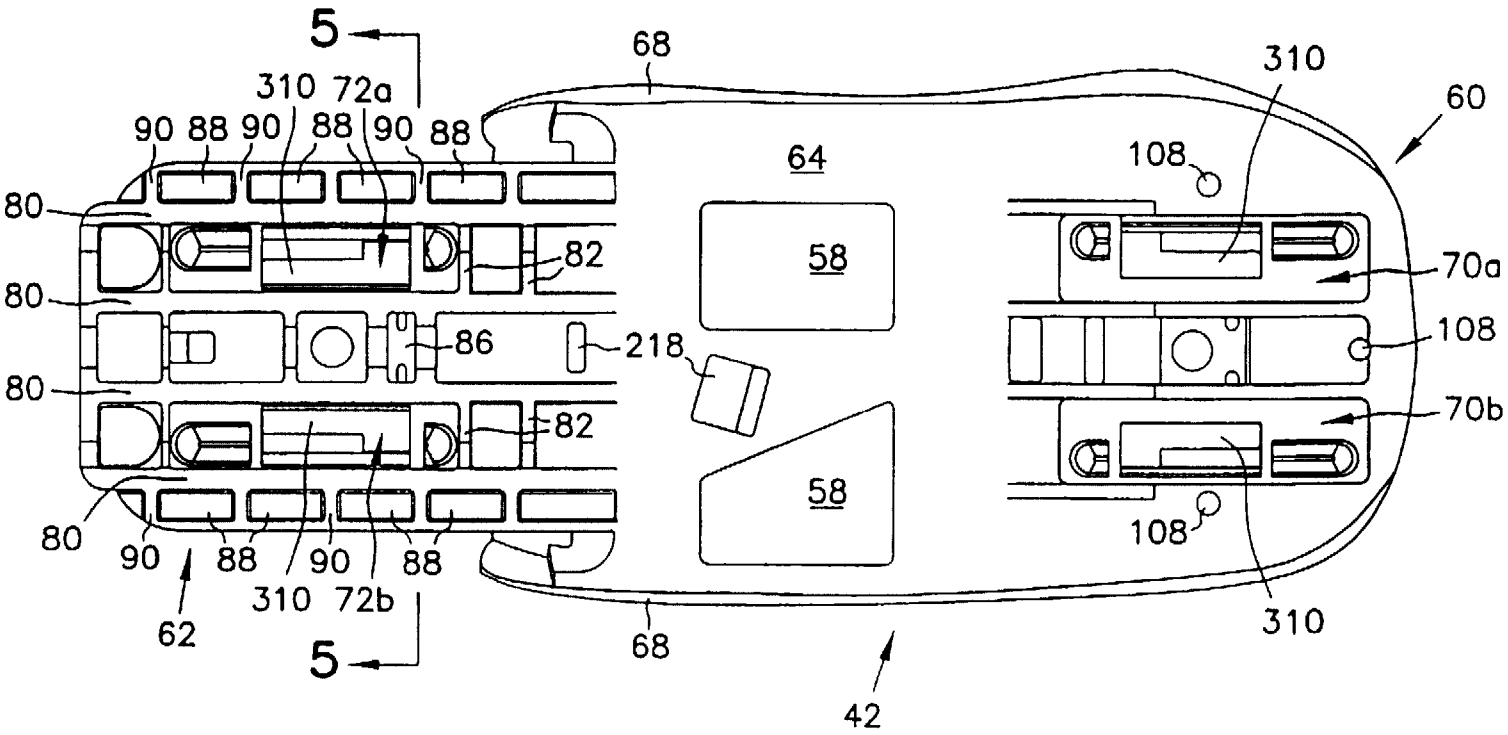
FIG. 3 is top plan view of the base section of the boot as illustrated in FIG. 2.
Figure 4:
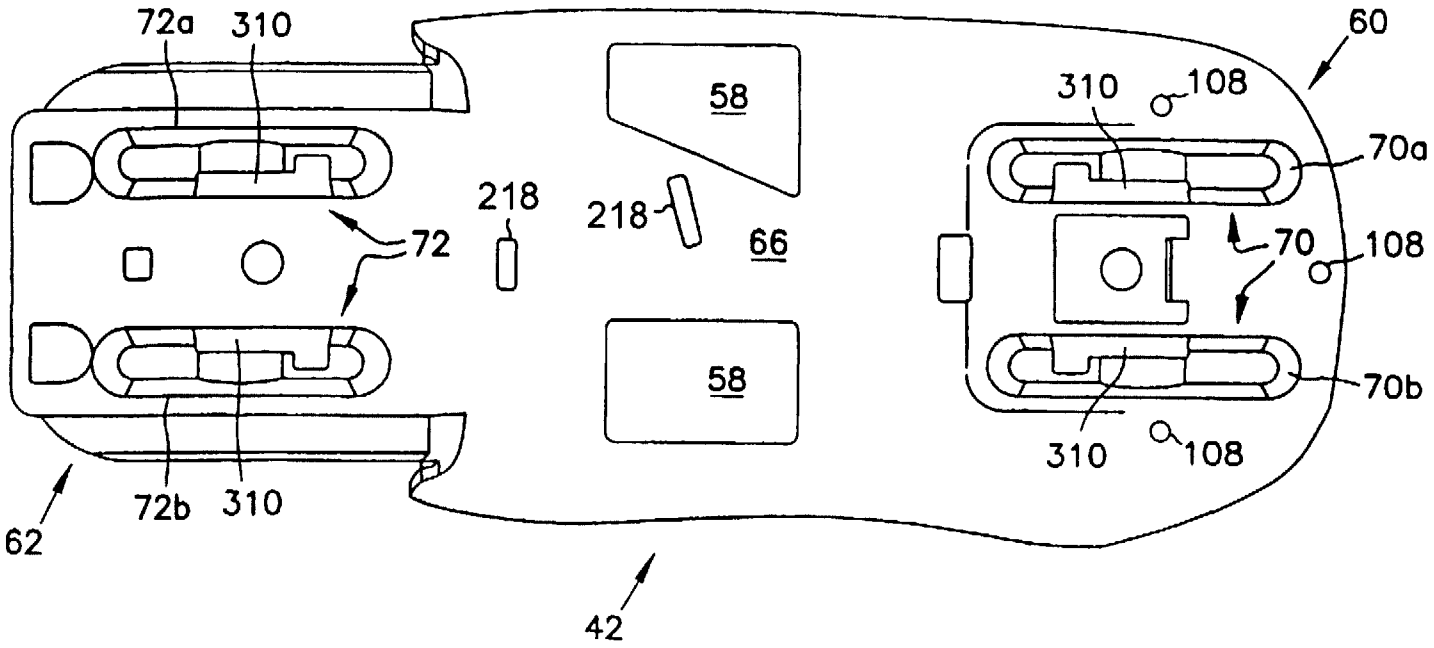
FIG. 4 is a bottom plan view of the base section of FIG. 3.

As illustrated in FIGS. 3 and 4, base section 42 is preferably molded as a one-piece unitary component from a high strength, substantially rigid nylon, thermoplastic, composite or other material. Any number of materials may be used without departing from the scope of the present invention although one suitable material is well-known glass-filled nylon. To help reduce the weight of boot 22 and minimize the cost of producing base section 42, strategically placed openings 58 may be formed in the base section. Openings 58 reduce the amount of material necessary to fabricate the component but must not adversely affect the strength and performance of the base section 42. Base section 42 must withstand the bending and torsional loads during use of boot 22, so the material selected and structural design must combine to provide a relatively stable, durable and rigid construction.

Base section 42 has a toe end 60 at one end and a rear end 62 at its opposite end. Base section 42 has an upper surface 64 on its top side and a bottom surface 66 on the opposite side. Upper surface 64 forward of rear end 62 is intended to have a surface contour generally corresponding to the plantar or bottom surface of a user's foot. Extending upwardly from upper surface 64 on either side adjacent rear end 62 are a pair of raised arch supports 68 intended to generally position and retain a user's foot therebetween.

Bottom surface 66 includes a toe attachment bracket 70 and a heel attachment bracket 72 coinciding with toe end 60 and rear end 62, respectively, for receiving wheel bracket 24 thereon. Attachment brackets 70 and 72 are preferably integrally molded with bottom surface 66 and are of a substantially rigid construction. The construction of rear end 62 is not intended to be limited to the description herein, but as will be seen to those of ordinary skill in the art, may take on other constructions and configurations without departing from the scope of the present invention.

Figure 5:
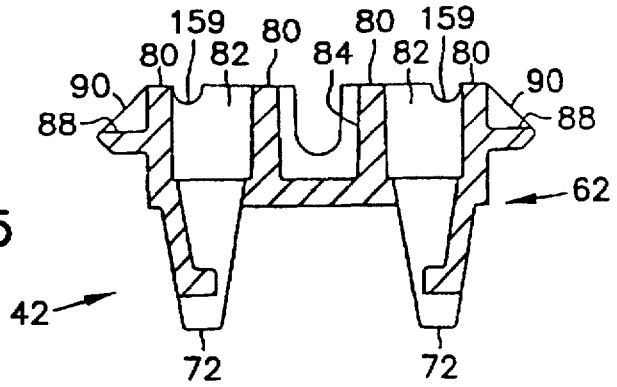
FIG. 5 is an end cross sectional view taken along line 5—5 of FIG. 3 of the base section.

FIG. 5 illustrates a cross-sectional view of rear end 62 which is intended to telescopically receive thereon heel section 40 such that the heel section is longitudinally slidable along the rear end as will be described in more detail below. Rear end 62 includes a plurality of longitudinal vertical structural members 80 integrally molded therein for adding structural rigidity to the rear end. A plurality of cross members 82 are integrally molded into rear end 62 essentially perpendicular to structural members 80 for increasing the structural rigidity of rear end 62. A pocket 84 is molded into rear end 62 between the two central structural members 80 for receiving a threaded fastener 86 therein. Extending radially outwardly from structural members 80 are a pair of heel section guides 88 for guiding heel section 40 onto rear end 62 and vertically and laterally orienting and positioning the heel section relative to rear end 62. A plurality of angled buttress members 90 are integrally molded into rear end 62 interconnecting the upper surface of heel guides 88 with structural members 80 for adding structural rigidity to the heel guides and to the rear end. Fastener 86 has a threaded opening 92 therethrough and is for providing length adjustment for boot 22 which will be described in more detail herein.

As will be evident to those skilled in the art, threaded opening 92 may be molded directly into rear end 62 of base section 42. A solid cross member may be molded between the two central structural members 80 in place of pocket 84 and may have formed therethrough a threaded opening. Fastener 86 may be constructed from any number of materials but is preferably a typical heat-treated steel fastener. Steel threads are more durable than threads formed from the preferred glass-filled nylon material of base section 42 but without proper treatment or care may oxidize.

Figure 6:
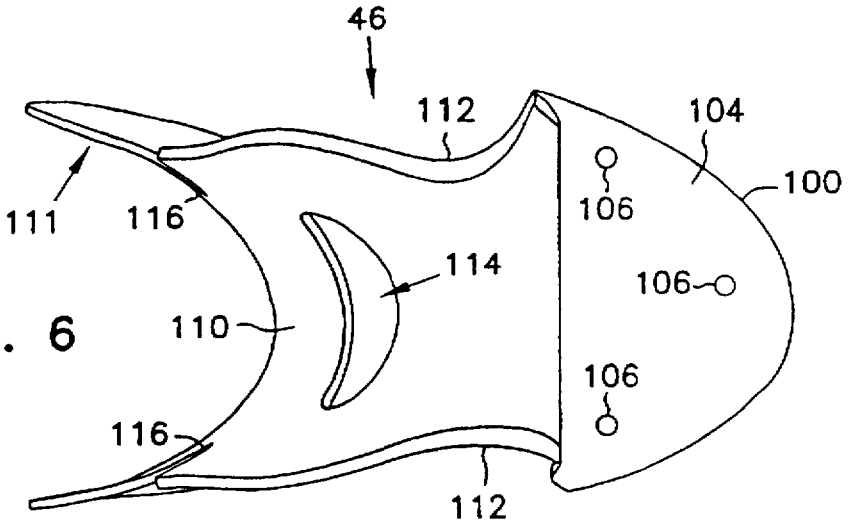
FIG. 6 is a bottom plan view of the tongue section of the boot as illustrated in FIG. 2.

Tongue section 46 is illustrated in FIGS. 2 and 6. Tongue section 46 includes a toe cap 100 which forms the toe of boot 22 and has a contoured outer surface 102 generally conforming to the shape of the distal end of a user's foot. Toe cap 100 includes a bottom surface 104 corresponding to upper surface 64 adjacent toe end 60 of base section 42. Bottom surface 104 includes three attachment openings 106 which correspond to three openings 108 in toe end 60 for affixing tongue section 46 to base section 42. In one embodiment as best illustrated in FIG. 2, tongue section 46 is attached to base section 42 by rivets 109 which pass through openings 106 and 108.

Tongue section 46 also includes a tongue 110 integrally molded with toe cap 100 and extending upwardly and rearwardly relative to base section 42 when assembled. Tongue 110 terminates at a free end 111 and extends from outer surface 102 of toe cap 100 to its free end. Tongue 110 of the present embodiment includes an inward taper 112 on either side of the tongue adjacent toe cap 100 reducing the material span of the tongue across its width. A flex opening 114 is further added in tongue 46 further decreasing the material span across the width of the tongue for adding flexibility. A pair of edge cutouts 116 disposed on tongue 46 between flex opening 114 and free end 111 are added to further increase the flexibility of tongue 110. Tapers 112, flex opening 114, and cutouts 116 also reduce the mass and cost of material necessary to manufacture tongue section 46.

Tongue section 46 of the present embodiment is preferably molded of a semi-flexible and resilient thermoplastic elastomer material or the like which has plastic memory. Tongue section 46 is molded to generally conform to an average user's dorsal foot surface, front ankle joint and lower shin. By forming the tongue of a semi-flexible material which has plastic memory and adding surface features such as tapers 112, flex opening 114 and edge cutouts 116, tongue 110 retains its natural molded shape and yet flexes and conforms easily to a user's foot shape and movement when in use. Toe cap 100 is preferably somewhat rigid and inflexible despite the semi-flexible material because of its partially enclosed cap shape.

Because it is desirable that base section 42 be substantially rigid and that tongue 110 be resilient and somewhat flexible, it is preferred that the two components are molded separately from different materials and attached as described above. Any number of materials may be used to fabricate tongue section 46 without departing from the scope of the invention, depending on the desired strength and flexibility characteristics for the particular design. The two components may also be molded as an integral unit without departing from the scope of the present invention as will be evident to those skilled in the art.

Figure 6A:
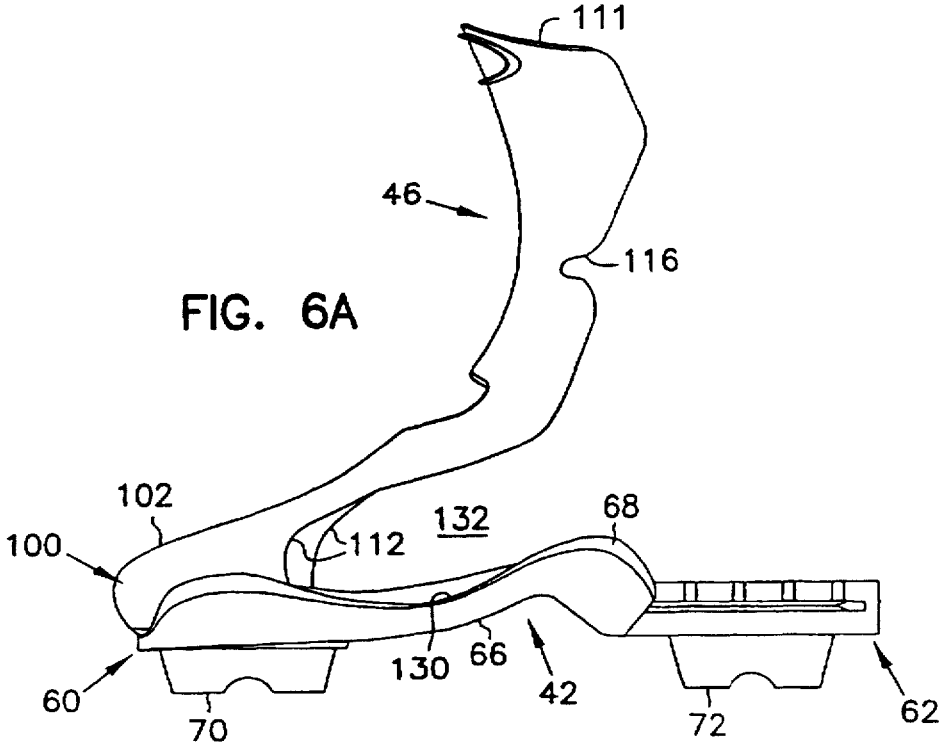
FIG. 6A is a side view of the tongue section and base sections as assembled of the boot illustrated in FIG. 1.

The assembled tongue section 46 and base section 42 are illustrated in FIG. 6A. A low side wall 130 is disposed on each side of base section 142 between toe end 60 and each raised arch support 68. Each of low side walls 130 combines with one of tapers 112 to define an open boot side 132 on each side of boot 22. Open boot sides 132 are intended to essentially correspond with the widest portion across the metatarsus or ball of the user's foot to accommodate various foot widths. Although they assist in adding flexibility to the tongue and in reducing the amount material necessary to make tongue section 46, tapers 112 in tongue 110 are essentially provided to form open boot sides 132.

A foot space 134 is generally defined by the area between tongue 110 and base section 42. Foot space 134 varies somewhat in height relative to the amount of flex of tongue 110 upon interacting with a particular foot of a user. Open boot sides 132 accommodate feet of various widths and foot space 134 accommodates feet of various heights to provide the width and height size-adjustable features of the sport boot of the present invention. Different foot widths and heights are therefore accommodated independently of one another.

Figure 7:
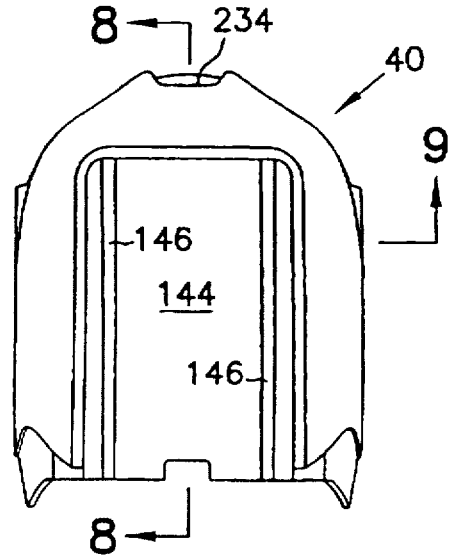
FIG. 7 is a bottom plan view of the heel section of the boot as illustrated in FIG. 2.
Figure 8:
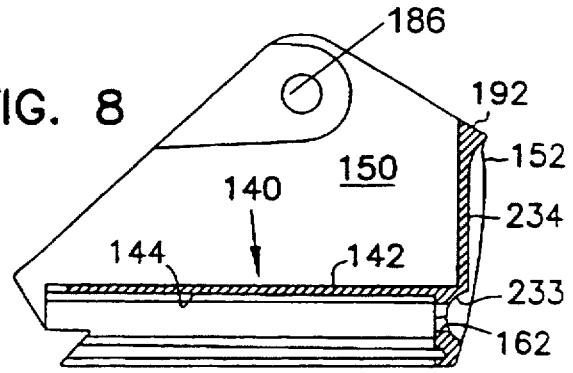
FIG. 8 is side cross sectional view taken along line 8—8 of FIG. 7 of the heel section.
Figure 9:
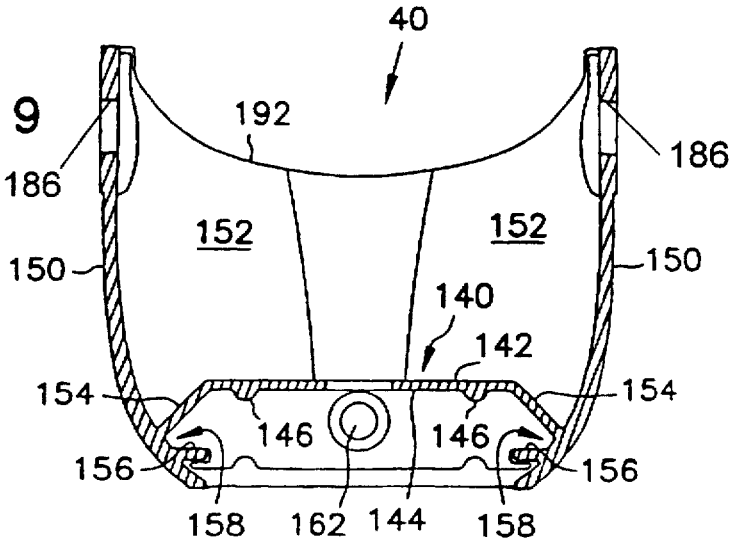
FIG. 9 is an end cross sectional view taken along line 9—9 of FIG. 7 of the heel section.

Heel section 40 is illustrated in FIGS. 7, 8 and 9. Heel section 40 includes a generally horizontal heel surface 140 having a top surface 142 and bottom surface 144, the top surface for supporting a user3 s heel thereon. Bottom surface 144 includes a plurality of longitudinal ribs 146 which add structural integrity to heel surface 140, but more importantly, provide glide surfaces to reduce sliding and static friction between heel section 40 and rear end 62 of base section 42. As best shown in FIG. 2, heel section 40 includes a curved, U-shaped vertical heel wall which has a pair of generally opposed sidewalls 150 and an integral rear wall 152. Heel sidewalls 150 and rear wall 152 follow the general contour of a user's heel and lower Achilles tendon.

Figure 10:
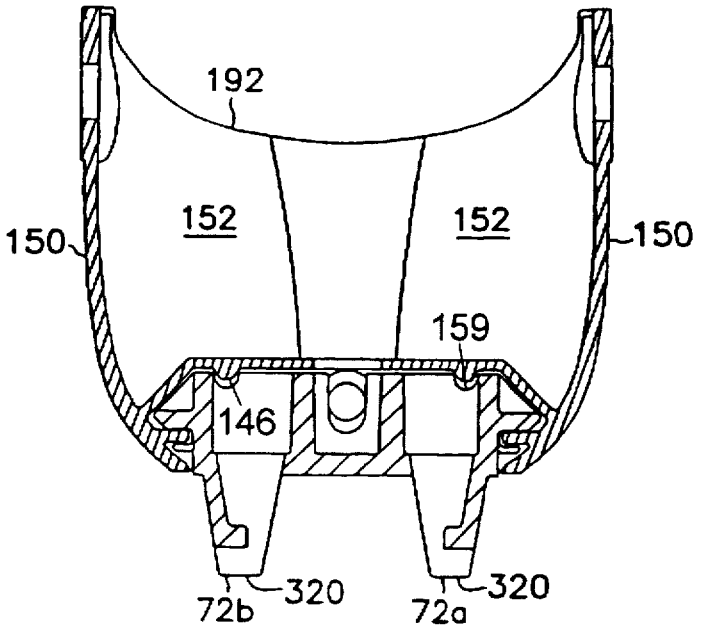
FIG. 10 is a cross sectional view taken along line 10—10 of FIG. 1 of the assembled heel and base sections.

Heel surface 140 extends forwardly from rear wall 152 as best illustrated in FIGS. 8 and 9. Longitudinal support members 154 extend inwardly and upwardly from each of sidewalls 150 and connect with and support heel surface 140. A base section guide member 156 projects inwardly from each sidewall 150 beneath each support member 154 and adjacent the juncture between each sidewall 150 and each support member 154. Each guide member 156, support member 154 and a portion of bottom surface 144 of heel surface 140 combine to define a slide track or groove 158 for receiving therein and guiding rear end 62 of base section 42 as shown in FIG. 10. A recess 159 may be formed in each appropriate cross member 82 of rear end 62 for receiving one of ribs 146 therein as illustrated in FIG. 10.

Figure 11:
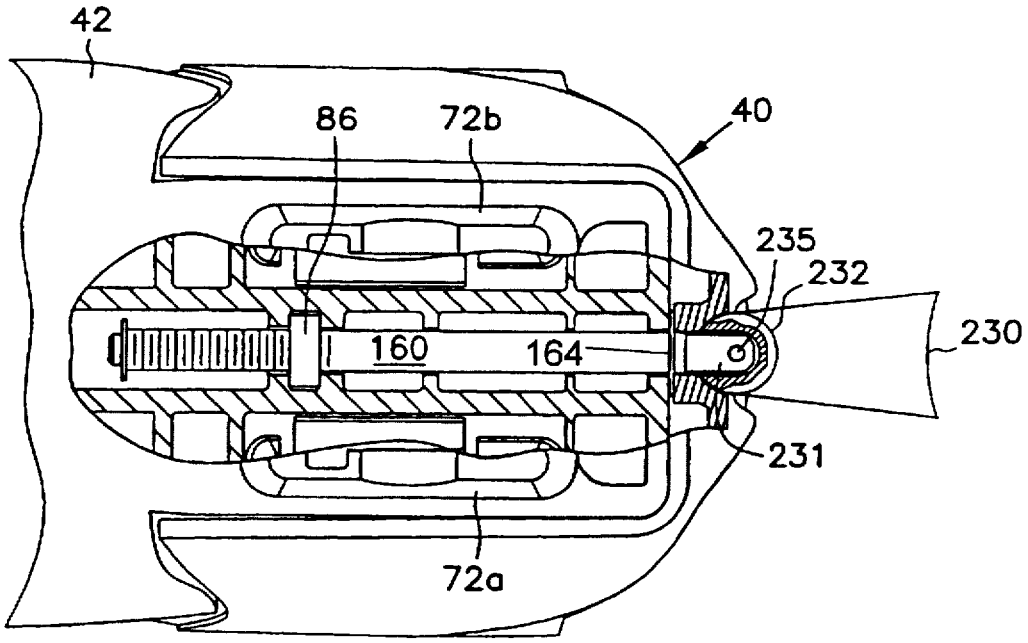
FIG. 11 is a top plan view of a portion of the assembled heel and base sections of the boot illustrated in FIG. 1 with the heel surface partially broken away.

As best illustrated in FIG. 2, an elongate rod 160 having external threads is received through a rod opening 162 formed in the lower end of rear wall 152. Threaded rod 160 may be retained in rod opening 162 by any suitable means such as a snap ring 164 as shown in FIGS. 2 and 11. As rear end 62 of base section 42 is received in heel section 40, heel guides 88 ride along guide members 156 on the heel section in slide tracks 158. As heel section 40 is moved toward toe end 60 of base section 42, threaded rod 160 comes into contact with fastener 86. The threads of threaded opening 92 correspond to the threads formed externally on threaded rod 160. To control and adjust the longitudinal position of heel section 40 relative to base section 42, threaded rod 160 is rotated to engage fastener 86 and to draw heel section 40 forward. Reverse rotation of threaded rod 160 will reverse the direction of movement of the heel section relative to the base section. Heel surface 140 of heel section 40 combines with upper surface 64 of base section 40 to define the adjustable length foot support surface or sole plate of boot 22. The length of the foot support surface is dependent upon the longitudinal position of heel section 40 relative to base section 42.

Heel section 40 is preferably molded from a sufficiently rigid material similar to that used to form base section 42 such as glass-filled nylon. Heel section 40 and base section 42 combine to form the base of boot 22 and thus must have sufficient structural rigidity to withstand the loads applied by a user's foot during use. Again, as will be evident to those skilled in the art, any number of materials may be suitable to form heel section 42 without departing from the scope of the present invention. Cuff 44 on the other hand is preferably less rigid than base section 42 but more rigid than tongue section 46. Cuff 44 supports a user's ankle and therefore must provide some structural rigidity but also must flex somewhat during use. Cuff 44 is therefore preferably molded from a high-strength semi-flexible material such as nylon, thermoplastic elastomer or other suitable materials.

Each portion of boot 22 serves a different purpose and has different requirements pertaining to stiffness, flexibility, resiliency an the like. Each of base section 42, heel section 40, tongue section 46 and cuff 44 is a separate molded element in the present embodiment. Each section may be molded from a material selected to meet the particular performance characteristics and may differ from the materials to manufacture the other sections. It is however within the purview of the present invention to mold some or all of the major boot components from the same material.

Cuff 44 has a semi-cylindrical cross-sectional shape intended to generally follow the contour of and wrap around a user's rear upper ankle and Achilles tendon area and includes a pair of generally opposed sidewalls 180 and a back wall 182 Formed through the lower end of each sidewall 180 is a rivet opening 184 for attaching cuff 44 to heel section 40. A corresponding rivet opening 186 is formed in each sidewall 150 of heel section 42 for attaching cuff 44 thereto. In one preferred embodiment as illustrated in FIG. 1, each sidewall 180 of cuff 44 overlaps a sidewall 150 on the inside of heel section 42. When rivet openings 184 and 186 are aligned, a rivet 188 is preferably inserted through rivet opening 186 of heel section 42 and then through rivet openings 184 and secured in a conventional manner. It is desired that cuff 44 be rotatable about rivets 188 forward and rearward relative to heel section 40 as illustrated in FIG. 12. The rearward rotation of cuff 44 assists a user in inserting his or her foot into boot 22 and the forward and rearward rotation allows for greater forward and rearward mobility for the user's ankle when boot 22 is in use.

A contoured bottom edge 190 of cuff back wall 182 and a contoured upper edge 192 of heel section rear wall 152 in combination define a heel opening in boot 22. The heel opening permits rearward rotation of cuff 44 relative to heel section 40 but performs an additional function as well. As a user leans forward and cuff 44 rotates forward, bottom edge 190 of the cuff also rotates forward against a user's leg above their heel. The user's heel is held down in heel section 40 by abutting against bottom edge 190. To enhance the forward movement of bottom edge 190, rivets 188 may be slightly offset or non-parallel relative to one another causing the cuff sidewalls 180 to flair out when rotated forward. This further causes bottom edge 190 to pull forward against the user's leg.

The embodiment described above having a slidable heel section is used to illustrate the present invention but is not intended to so limit the scope of the invention. A 3-D fit boot may be constructed having a heel section rigidly carried by a base section with the length adjustment feature provided by a toe section or combined tongue and toe section which is longitudinally adjustable relative to the base section.

Adjustment enhancement mechanisms are included on boot 22 to aid in conforming the 3-D fit boot to the contour and size of a particular foot. In one embodiment illustrated in FIGS. 1 and 2, a front strap 200 (FIG. 2), a combined front and middle strap 202 (FIG. 1), a middle strap 204 (FIG. 2) and an upper strap 206 are carried by boot 22 for enhancing boot adjustment. Strap 202 has a front strap portion 200*a* and a middle strap portion 204*a* intended to be positioned and oriented as described below for front and middle straps 200 and 204.

Each strap is of a conventional construction including a plurality of interdental notches formed on a band attached to one end of each strap. A releasable pawl is carried on the other end of each strap for adjusting the strap length for a particular user. A conventional clamp 212 is carried on each strap for tightening and locking each strap to a desired tension. Straps 200, 202, 204 and 206 are preferably molded from a flexible thermoplastic material having high tensile strength such as a thermoplastic elastomer or other suitable material. The adjustment enhancement mechanisms may also be provided which are formed from other materials such as fabrics without departing from the scope of the invention. A lace-up unit or a unit combining more than one type of mechanism may also be incorporated.

Front strap 200 is preferably located nearest the toe end of boot 22 such that it essentially overlaps open sides 132 of the boot when installed. Front strap 200 preferably has a wider cross section in the area where it overlaps each open side 132 of boot 22 so that when it is secured around the boot, it forms a constructive boot side over each open side 132. This allows boot 22 to accommodate feet of varying widths and yet provide the lateral stability necessary for a high performance boot.

Front strap 200 wraps completely under and around base section 42 and tongue 110 of boot 22 providing excellent fit and adjustment characteristics. Front strap 200 includes a pair of tabs 216, each intended to be received in a corresponding slot 218 on bottom surface 66 of base section 42. Slots 218 and tabs 216 positively align and position strap 200 when installed on boot 22. The use of the slots and tabs instead of permanently attaching strap 200 to base section 42 allows the strap to be removable, interchangeable and replaceable, permitting a user to change the performance characteristics and aesthetic appearance of the boot as well as to replace a damaged or worn out strap.

Middle strap 204 is included to permit a user to adjust boot 22 over the tongue section 46 to conform tongue 110 to their foot as desired. Strap 204 is of essentially the same construction as strap 200 except the configuration and length of the strap and the location of any slots and tabs may be varied to accommodate attachment nearest heel end of boot 22. As shown in FIG. 1, front strap 200*a* and middle strap 204*a* may be integrally formed and interconnected. FIG. 2 illustrates front strap 200 and middle strap 204 as separate straps. The unitary construction of combined strap 202 adds more stability to boot 22 and reduces the number of separate components, whereas having two separate straps permits separate replacement and interchangeability. A single wrap-around strap similar to that shown in FIG. 1 may include laces in place of the teeth, pawl and clamp for selectively adjusting the strap without departing from the scope of the invention.

Upper strap 206 is again similar in construction to straps 200 and 204 but wraps around cuff 44 and tongue section 46. Strap 206 is positioned and retained on cuff 44 by slots and tabs similar to slots 218 and tabs 216. Strap 206 is intended to permit a user to adjust and secure free end 111 of tongue 110 and back wall 182 of cuff 44 around a user's ankle when in use. Strap 206 also permits a user to release free end 111 from the strap such that cuff 44 may be rotated rearward when removing or inserting their foot in boot 22.

In the present embodiment, an adjustment lever 230 is pivotally attached to an external end 231 of threaded rod 160 by any suitable means, such as a spring pin 235. Lever 230 has a ball 232 received in a socket 233 of heel section 44 and is rotatable to a position generally parallel to rod 60. Lever 230 provides a rotation or adjustment handle for a user to set the desired length of the foot support surface or sole plate and hence the length of boot 22. When lever 230 is not in use, it is rotated by the user to a position essentially parallel with rear wall 150 of heel wall 148. A recess 234 is molded into rear wall 150 for receiving lever 230 therein. A detent may be provided for lever 230 or ball 232, socket 233 or both by any suitable means to retain the lever in position within recess 234. A detent may also be provided on lever 230 in a side of recess 234 for the same purpose.

As will be evident to those skilled in the art, any number of lever or knob mechanisms and designs may be used for adjusting the boot length without departing from the scope of the present invention. A recessed knob or screw head permits continuous or "infinite" adjustment. The lever of the present embodiment permits adjustment in increments related to one revolution of rod 160 and lever 230. An adjustment lever or knob may be disposed on bottom surface 66 of base section 42 or on the bottom of heel section 40 and fall within the scope of the present invention.

Tongue section 46 and base section 42 may be molded to conform to either a user's left foot or right foot. The general configuration of toe end 60 and arch supports 68 of base section 42 vary depending on whether base section is for a left or right foot. The contour of tongue 110 and toe cap 100 also are dictated by whether the 3-D fit boot is for a left or right foot. The contour of boot liner 48 is also left or right foot dependent.

Figure 13:
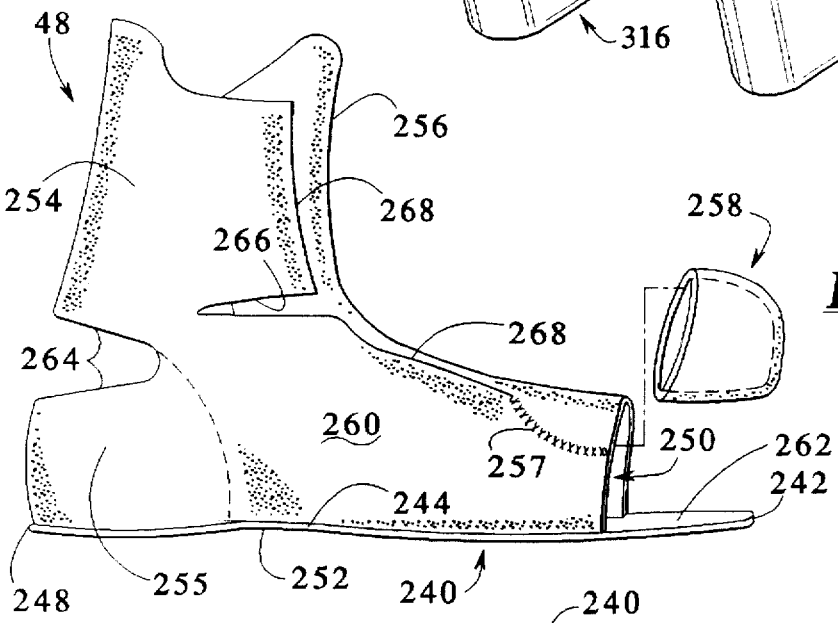
FIG. 13 is a side view of a boot liner for the in-line skate illustrated in FIGS. 1 and 2.
Figure 13A:
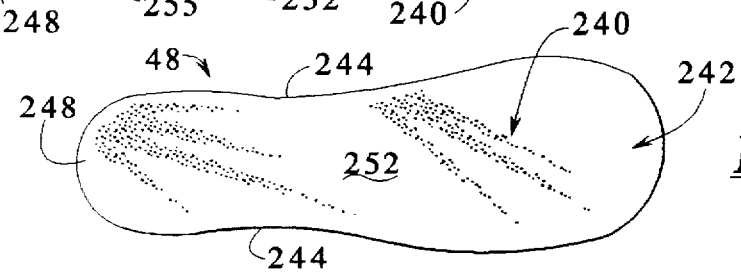
FIG. 13A is a bottom perspective view of the boot liner illustrated in FIG. 13.

Boot liner 48 may take on any number of constructions and configurations without departing from the scope of the present invention. Boot liner 48 must, however, accommodate feet of different sizes as does boot 22. In one embodiment illustrated in FIGS. 13 and 13A, boot line has a sole 240 with a forward end 242, a pair of opposed sides edges 244 and a heel end 248. Boot liner 48 has an open toe end 250 adjacent forward end 242 of sole 240 and a bottom surface 252 on the sole.

A liner cuff 254 is disposed above and attached to a liner heel 255 which is attached along its bottom edge to heel end 248 of sole 242. A liner tongue 256 is attached to liner 48 adjacent open toe end 250 by any suitable means such as a sewn seam 257. Cuff 254 and heel 255 correspond to cuff 44 and heel section 40, respectively, of boot 22. Tongue 256 and open toe end 250 correspond to tongue section 46 and toe cap 100, respectively, of boot 22. Tongue 256 may be incorporated into either liner 48 or attached to a separate toe section 258 which is received within and adhered to toe cap 100 of boot 22. Liner 48 also includes a pair of opposed sides 260 attached along their bottom ends to sole side edges 244. Toe section 258 of liner 48 need not be included but is a desirable feature for providing a padded surface for comfort and protection between a user's toes and toe cap of boot 22.

Boot liner 48 may be constructed from any number of materials without departing from the scope of the present invention. In one embodiment, a breathable mesh foam such as nylon polyester is used to construct liner 48. Other materials such as ethyl vinyl acetate foam, natural fabrics such as cotton or wool, or a combination thereof may be used to construct liner 48. To help keep a user's foot dry while using an athletic boot of the present invention, boot liner 48 may also be constructed from materials which absorb or wick moisture away from a user's foot and transfer the moisture away from high-moisture areas to areas where it can evaporate into the atmosphere.

For example, the sole bottom surface 252 and heel 255 may be constructed from a high absorbency material such as WICKSPUN™ cotton available from Monsanto Corporation. Liner sides 260 disposed between heel 255 and open toe end 250 may be constructed from a material which absorbs and transfers moisture such as DURASPUN™ SMART YARNS®, also available from Monsanto Corporation. As a user's foot perspires, moisture may be drawn from heel 255 and base 252 into liner sides 260 where it can evaporate or be transferred to cuff 254 where it will more easily evaporate. Such a combination of materials is described in U.S. Pat. No. 4,898,007, assigned to Dahlgren Footwear, Inc.

Forward end 242 of sole 240 extends beyond open toe end 250 which rolls up into toe cap 100 when boot 22 is adjusted to its shortest length. Forward end 242 rolls back down adjacent to the foot support surface base section 42 when boot 22 is adjusted to a longer length. Forward end 242 provides a liner surface 262 over the entire length of the foot support surface regardless of the adjusted length of boot 22.

Additionally, a heel opening 264 may be included between liner cuff 254 and heel 255 which permits movement of cuff 254 forward and rearward along with boot cuff 44 without upward movement of heel 255. Thus, heel 255 will tend to stay seated within heel section 40 of boot 22 when a user leans forward within the boot. An additional slit 266 may be included on each side of boot liner 48 adjacent tongue 256 which aids boot liner 48 in performing both functions. A longitudinal split 268 on liner 48 beneath tongue 256 is included allowing the liner to expand upward and laterally. Split 268 allows liner 48 to accommodate feet of different widths and heights as is necessary for use with boot 22.

Sole 240 may also include a no-slip padded surface attached to or formed on bottom surface 252. A no-slip surface permits a user to remove a pair of boots 22 from their feet, remove the liners 48 from within the boots, and use the liners for walking. Many places of business do not permit people to enter while wearing certain types of footwear such as in-line skates. A boot liner 48 having a walking sole formed on bottom surface 252 would permit a user to travel on in-line skates without having to carry an extra pair of shoes for use in such places.

Figure 16:
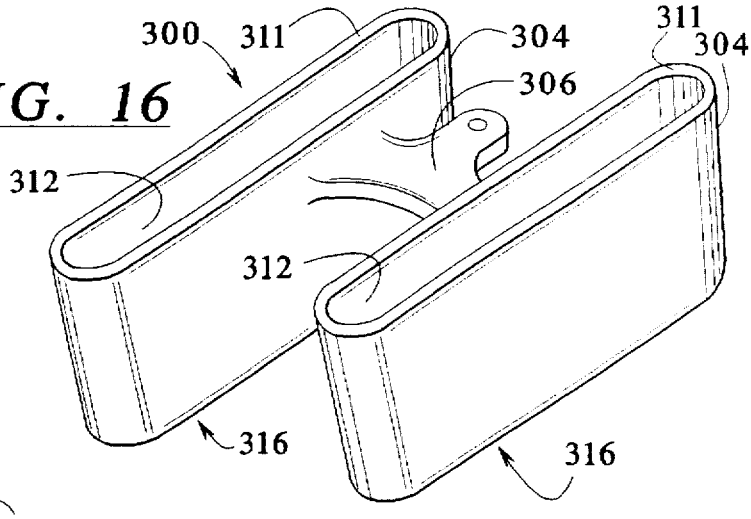
FIG. 16 is a perspective view of the walking pad of FIG. 14.

As an alternative, a walking pad 300 is illustrated in FIGS. 14, 15 and 16 for attachment to each of brackets 70 and 72 of boot 22. Walking pads 300 provide a no-slip and no-scuff surface converting boot 22 from an in-line skate to a walking shoe. Walking pads 300 may be constructed from any number of materials such as urethane rubber or the like and be molded having a no-slip surface formed on the bottom of each pad. Pads 300 may take on any number of configurations and constructions to accommodate a particular athletic boot and attachment bracket construction.

Pads 300 of the present embodiment include a pair of main body sections or cupped sections 304 and a bridge 306 connecting the body sections and forming a one-piece walking pad construction. Brackets 70 and 72 of the present embodiment each include a pair of adjacent depending members 70*a*, 70*b* and 72*a*, 72*b*, respectively. Each depending member 70*a*, 70*b*, 72*a*, and 72*b* has an inner side wall 308 with an opening 309 formed therein exposing a lip 310 is formed on the inside of each depending member 70*a*, 70*b*, 72*a* and 72*b*. Lips 310 of the present embodiment are used for attaching wheel bracket 24 to base section 42. Each cup section or main body section 304 of the walking pads has an open upper end 311 communicating with a recess 312 in main body sections 304. Within each recess 312 is a boss 313 molded to correspond to each lip 310.

Each main body section 304 is intended to be received on one of depending members 70*a*, 70*b* and 72*a*, 72*b* of brackets 70 and 72. Each recess 312 has a contour corresponding to the outer contour of the depending members. One of depending members 70*a*, 70*b* and 72*a*, 72*b* is received through open upper end 311 into recess 312 of each body section 304. Boss 313 of each main body section 304 overlaps each lip 310 to retain walking pads 300 on brackets 70 and 72.

Each main body section has a lower end 316 with a surface formed thereon which provides a suitable walking surface. Lower end 316 will contact many surfaces such as rough concrete and slippery tile floors so it must be durable and yet have no-slip characteristics. The type of material used to manufacture walking pads 300 will therefore be important as will the design of any surface pattern to provide proper traction and durability.

Walking pads 300 may alternatively be formed such that they are held on either of brackets 70 or 72 by static surface friction between the inside surface of each of main body sections 304 and its adjacent depending member 70*a*, 70*b*, 72*a*, and 72*b*. As will be evident to those skilled in the art, lips 310, bosses 312, main body sections 304 and walking pads 300 may vary substantially from the present embodiment without departing from the scope of the invention.

Alternatively, each of brackets 70 and 72 may include an opening in a bottom surface 320 of each depending member 70*a*, 70*b*, 72*a*, and 72*b* and be formed such that they are at least partially hollow. A suitable rubber or relatively soft plastic material may be molded or inserted into depending member 70*a*, 70*b*, 72*a*, and 72*b* having a portion of the material extending through the bottom surfaces 320. The material extending beyond bottom surfaces creates a no-slip walking pad on the bottom of each bracket which is exposed when wheel bracket 24 is removed from boot 22 and covered when the wheel bracket is in place on attachment brackets 70 and 72. Again, such a construction may take on any number of shapes and configurations depending on the type of bracket construction, if any, on the athletic boot without departing from the scope of the present invention.

One important aspect of the present invention is that the in-line skate 20 has a modular construction. A user may remove, replace and interchange many components of the in-line skate 20 as desired. Having a removable liner, removable adjustment mechanisms, and removable wheel brackets allows a user to modify the appearance and performance of the in-line skate to meet their particular requirements.

Another important aspect of the present invention is that heel section 40 moves relative to base section 42 independent of heel attachment bracket 72 which is carried by the base section. Referring to in-line skate 20 of FIG. 1, this allows use of a common length wheel bracket 24. Wheel brackets therefore need not be adjustable in length along with 3-D fit boot 22. Wheel brackets 24 also need not be designed to accommodate a moveable attachment bracket nor be manufactured in incremental lengths corresponding to incremental varying traditional boot sizes.

The attachment members of a ski boot on the other hand typically extend from the heel and toe ends of the boot as in FIG. 1C with their spacing relative to one another being boot length dependent. The present invention easily permits any attachment brackets or members be adjustable along with the length adjust components of the boot as will be evident to those skilled in the art. A ski boot may have attachment brackets similar to in-line skate 20 which attach directly to a ski as in FIG. 1E. This allows boot length variation independent of bracket spacing.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A size adjustable in-line roller skate boot of a molded construction comprising:

a foot support surface having a length;

a base section having an upper base surface defining a portion of said foot support surface, a toe end, a rear end, and a bottom base surface;

a front and a rear wheel attachment bracket adjacent said toe end and said rear end, respectively, and depending from said bottom surface of said base section, said front and rear wheel attachment brackets being spaced apart a fixed distance;

a resilient tongue section having a fixed end adjacent said toe end of said base section and a free end;

a heel section slidably carried on said rear end of said base section and having an upwardly extending heel wall;

a cuff extending generally upward from said heel wall;

an adjustable securing mechanism adapted to releasably secure said skate boot to a user's foot; and a length adjust mechanism adapted for positioning said heel section and said toe end of said base section relative to one another to vary said length of said foot support surface of said skate boot without varying said fixed distance between said front and rear wheel attachment brackets.

2. The skate boot of claim 1 wherein said heel section in combination with said upper base surface defines said foot support surface.

3. The skate boot of claim 1 wherein said adjustable securing mechanism comprises at least one adjustable strap carried by said skate boot.

4. The skate boot of claim 3 wherein said at least one adjustable strap comprises a front strap which wraps over said tongue section and under and around said base section adjacent said toe end.

5. The skate boot of claim 3 wherein said at least one adjustable strap comprises a middle strap which wraps over said tongue section and under and around said base section between said rear end and said front strap.

6. The skate boot of claim 1 further comprising a removable boot liner received therein.

7. The skate boot of claim 6 wherein said boot liner further comprises an open toe end to accommodate feet of different lengths.

8. The skate boot of claim 6 wherein said boot liner comprises a bottom surface including thereon a material suitable for walking.

9. The skate boot of claim 1 wherein said length adjust mechanism comprises a threaded rod which when rotated moves said heel section longitudinally along said rear end of said base section forward and rearward depending on a direction of rotation of said threaded rod.

10. The skate boot of claim 9 wherein said threaded rod is carried by said heel section.

11. The skate boot of claim 10 wherein said threaded rod comprises an adjustment lever attached thereto for manually rotating said rod, said adjustment lever being moveable between an extended and a retracted position.

12. The skate boot of claim 11 wherein said adjustment lever is received in a recess in said heel section when in said retracted position.

13. The skate boot of claim 1 further comprising a walking pad removably received on each of said front and rear attachment brackets, said walking pads providing a surface making said skate boot suitable for walking.

14. The athletic boot of claim 1 wherein said tongue section further comprises a toe cap integrally formed thereon and secured to said base section adjacent said toe end.

15. The athletic boot of claim 1 wherein said base section is molded from a substantially rigid glass filled nylon material.

16. The athletic boot of claim 1 wherein said tongue section is molded from a semi-flexible and resilient thermoplastic elastomer material.

17. The athletic boot of claim 1 wherein said heel section is molded from a substantially rigid glass filled nylon material.

18. The athletic boot of claim 1 wherein said cuff is molded from a semi-flexible and resilient thermoplastic elastomer material.

19. A size adjustable athletic boot of a molded construction comprising:

a foot support surface having a length;

a base section having an upper base surface defining a portion of said foot support surface, a toe end, a rear end, and a bottom base surface;

a front and a rear athletic device attachment bracket adjacent said toe end and said rear end, respectively, and depending from said bottom base surface of said base section, said front and rear attachment brackets spaced apart a fixed distance;

a resilient tongue section having a fixed end adjacent said toe end of said base section and a free end;

said base section and said tongue section in combination defining a foot space therebetween and defining an open side on each side of said boot;

a heel section slidably carried on said rear end of said base section and having an upwardly extending heel wall;

a cuff extending generally upward from said heel wall and in combination with said free end of said tongue defining a foot entry opening therebetween;

an adjustable securing mechanism adapted to releasably secure said athletic boot to a user's foot; and a length adjust mechanism for selectively positioning said heel section and said toe end of said base section relative to one another to vary said length of said foot support surface of said athletic boot without varying said fixed distance between said front and rear athletic device attachment brackets.

20. The athletic boot of claim 19 wherein said heel section in combination with said upper base surface defines said foot support surface.

21. The athletic boot of claim 19 wherein said athletic device comprises a plurality of in-line skate wheels carried by a wheel bracket attachable to said front and rear attachment brackets.

22. The athletic boot of claim 19 wherein said adjustable securing mechanism comprises at least one adjustable strap carried by said boot. surface including thereon a material suitable for walking.

23. The athletic boot of claim 22 wherein said at least one adjustable strap comprises a front strap which wraps over said tongue section and under and around said base section and overlaps each of said open boot sides for adjusting said athletic boot to accommodate feet of different widths.

24. The athletic boot of claim 22 wherein said at least one adjustable strap comprises a middle strap which wraps over said tongue section and around and under said base section between said rear end and said front strap for adjusting said foot space to accommodate feet of different heights.

25. The athletic boot of claim 22 wherein said at least one adjustable strap comprises an upper strap which wraps around said tongue section adjacent said free end and said cuff for adjusting said foot entry opening.

26. The athletic boot of claim 19 further comprising a removable boot liner received therein.

27. The athletic boot of claim 26 wherein said boot liner further comprises an open toe end to accommodate feet of different lengths.

28. The athletic boot of claim 26 wherein said boot liner comprises a bottom surface including thereon a material suitable for walking.

29. The athletic boot of claim 19 wherein said length adjust mechanism comprises a threaded rod which when rotated moves said heel section longitudinally along said rear end of said base section forward and rearward depending on a direction of rotation of said threaded rod.

30. The athletic boot of claim 29 wherein said threaded rod is carried by said heel section.

31. The athletic boot of claim 29 wherein said threaded rod comprises an adjustment lever attached thereto for manually rotating said rod, said adjustment lever being moveable between an extended and a retracted position.

32. The athletic boot of claim 31 wherein said adjustment lever is received in a recess in said heel section when in said retracted position.

33. The athletic boot of claim 19 further comprising a walking pad removably received on each of said athletic device attachment brackets, said walking pads providing a surface making said athletic boot suitable for walking.

34. The athletic boot of claim 19 wherein said base section is molded from a substantially rigid glass filled nylon material.

35. The athletic boot of claim 19 wherein said tongue section is molded from a semi-flexible and resilient thermoplastic elastomer material.

36. The athletic boot of claim 19 wherein said heel section is molded from a substantially rigid glass filled nylon material.

37. The athletic boot of claim 19 wherein said cuff is molded from a semi-flexible and resilient thermoplastic elastomer material.

* * * * *